US010731442B2

(12) United States Patent
Kumar

(10) Patent No.: US 10,731,442 B2
(45) Date of Patent: Aug. 4, 2020

(54) DOWNHOLE COMPLETION SYSTEM

(71) Applicant: WELLTEC OILFIELD SOLUTIONS AG, Zug (CH)

(72) Inventor: Satish Kumar, Allerød (DK)

(73) Assignee: Welltech Oilfield Solutions AG, Zug (CH)

( * ) Notice: Subject to any disclaimer, the term of this patent is extended or adjusted under 35 U.S.C. 154(b) by 267 days.

(21) Appl. No.: 15/420,395

(22) Filed: Jan. 31, 2017

(65) Prior Publication Data

US 2017/0218734 A1 Aug. 3, 2017

(30) Foreign Application Priority Data

Feb. 1, 2016 (EP) ..... 16153705
Mar. 9, 2016 (EP) ..... 16159378

(51) Int. Cl.
*E21B 43/08* (2006.01)
*E21B 43/10* (2006.01)
(Continued)

(52) U.S. Cl.
CPC ..... *E21B 43/08* (2013.01); *E21B 17/042* (2013.01); *E21B 33/127* (2013.01); *E21B 43/10* (2013.01); *E21B 43/105* (2013.01)

(58) Field of Classification Search
CPC ..... E21B 43/08; E21B 43/105; E21B 43/10; E21B 17/042; E21B 33/127
See application file for complete search history.

(56) References Cited

U.S. PATENT DOCUMENTS 5,868,200 A * 2/1999 Bryant ..... E21B 43/08 166/51
2009/0095471 A1* 4/2009 Guignard ..... E21B 34/14 166/278

FOREIGN PATENT DOCUMENTS

EP 2 381 811 5/2003
WO WO 2005/061852 7/2005
WO WO 2015/169959 11/2015

OTHER PUBLICATIONS

Extended Search Report for EP16159378.5 dated Oct. 4, 2016, 5 pages.

* cited by examiner

*Primary Examiner* — Brad Harcourt
(74) *Attorney, Agent, or Firm* — Nixon & Vanderhye P.C.

(57) ABSTRACT

The present invention relates to a completion system for connecting several screens into a well tubular structure mounted from base pipe sections. The completion system comprises a first screen assembly and a second screen assembly, each screen assembly comprising a base pipe section mounted as part of the well tubular structure having a longitudinal extension, the base pipe section having an outer face, and a tubular screen element surrounding and being connected to the outer face of the base pipe section, the tubular screen element having an outer diameter, and an assembly connection part for connecting an end of the first screen assembly with an end of the second screen assembly, wherein the completion system further comprises a first tubular member having an inner diameter which is equal to or larger than the outer diameter of the tubular screen element, the first tubular member being arranged opposite the assembly connection part so that fluid flowing in through the tubular screen element of one of the screen assemblies flows on the outside of the assembly connection part. Furthermore, the present invention relates to a completion method and a production method for producing hydrocarbon-containing fluid from a reservoir into a well tubular structure.

21 Claims, 6 Drawing Sheets

(51) Int. Cl.
*E21B 17/042* (2006.01)
*E21B 33/127* (2006.01)

DOWNHOLE COMPLETION SYSTEM

This application claims priority to EP Patent Application No. 16153705.5 filed Feb. 1, 2016 and EP Patent Application No. 16159378.5 filed Mar. 9, 2016, the entire contents of each of which are hereby incorporated by reference.

FIELD OF THE INVENTION

The present invention relates to a completion system for connecting several screens into a well tubular structure mounted from base pipe sections.

Furthermore, the present invention relates to a completion method and a production method for producing hydrocarbon-containing fluid from a reservoir into a well tubular structure.

BACKGROUND ART

When completing a well it is advantageous to have several screens so that if one screen is blocked the production fluid can flow through another screen, but connecting several screens is not easily performed. In the known solutions, the screens are designed so that mounting of the completion system at the rig is very complicated as the commonly used tools for connecting the well tubular structure cannot be used. Therefore, there is a need for an alternative so that the well tubular structure of the completion can easily be mounted by the known tools at the rig.

SUMMARY OF THE INVENTION

It is an object of the present invention to wholly or partly overcome the above disadvantages and drawbacks of the prior art. More specifically, it is an object to provide an improved completion system comprising several screen assemblies, and which can be mounted using conventional tools at the rig.

The above objects, together with numerous other objects, advantages and features, which will become evident from the below description, are accomplished by a solution in accordance with the present invention by a completion system for connecting several screens into a well tubular structure mounted from base pipe sections, comprising:

a first screen assembly and a second screen assembly, each screen assembly comprising:

a base pipe section mounted as part of the well tubular structure having a longitudinal extension, the base pipe section having an outer face, and a tubular screen element surrounding and being connected to the outer face of the base pipe section, the tubular screen element having an outer diameter, and an assembly connection part for connecting an end of the first screen assembly with an end of the second screen assembly, wherein the completion system further comprises a first tubular member having an inner diameter which is equal to or larger than the outer diameter of the tubular screen element, the first tubular member being arranged opposite the assembly connection part so that fluid flowing in through the tubular screen element of one of the screen assemblies flows on the outside of the assembly connection part.

The well tubular structure may have an opening for letting the fluid into the well tubular structure.

Moreover, one of the base pipe sections may have an opening for letting the fluid into the well tubular structure.

Further, the first tubular member and the base pipe section may form an annular flow channel.

Also, the completion system as described above may further comprise a first tubular member connector and a second tubular member connector, each having inner diameters which are equal to or larger than the outer diameter of the tubular screen element, the first tubular member being maintained in at least the longitudinal extension by the tubular member connectors.

Additionally, each screen assembly may comprise a screen element fixation part adapted to fixate the tubular screen element to the base pipe section.

The screen element fixation part may have at least one flow channel arranged along the longitudinal extension.

Furthermore, each screen assembly may comprise two screen element fixation parts adapted to fixate each end of the tubular screen element to the base pipe section.

Moreover, the first tubular member connector may be arranged so as to at least partly overlap the screen element fixation part of the first screen assembly, and the second tubular member connector may be arranged so as to at least partly overlap the screen element fixation part of the second screen assembly.

Also, the tubular member connectors may have internal threads.

In addition, the screen element fixation part may have an external thread.

Further, the internal thread of the tubular member connector may at least partly engage the external thread of the screen element fixation part.

Additionally, the tubular member may not be directly connected to the assembly connection part.

Moreover, the tubular member may have a distance to the outer face of the assembly connection part.

Furthermore, the assembly connection part may have an outer diameter which is larger than the outer diameter of the base pipe section.

The tubular member may comprise a screen.

In addition, the first tubular member connector and the second tubular member connector may be slidable on the outer face of the base pipe section during assembly of the first screen assembly and the second screen assembly.

The completion system as described above may further comprise a flow section mounted as part of the well tubular structure for allowing fluid to flow into or out of the well tubular structure.

Also, the flow section may be mounted between two screen assemblies.

Further, the flow section may have a first end mounted to one screen assembly and a second end mounted to another screen assembly.

Said flow section may have an opening for letting fluid from the screen assemblies into the well tubular structure.

Moreover, the completion system as described above may further comprise a second tubular member arranged opposite the flow section so that fluid flowing in through the tubular screen element of one of the screen assemblies flows on the outside of the base pipe section and in through the flow section, or vice versa.

Furthermore, the completion system as described above may further comprise at least one annular barrier assembly comprising:

a base pipe section for being mounted as part of the well tubular structure, the base pipe section comprising an aperture, an expandable sleeve surrounding the base pipe section and having an inner face facing the base pipe section and an outer face facing a wall of a borehole or another well tubular structure, each end of the expandable sleeve being connected with the base pipe section, and an annular space between the inner face of the expandable sleeve and the base pipe section.

Also, the completion system may comprise a plurality of screen assemblies.

In addition, the completion system may further comprise centralisers for centralising the well tubular structure when the structure is run in the borehole.

Further, the flow section may comprise a sliding sleeve for covering the opening.

The thread of the first tubular member connector may be a left hand thread and the thread of the second tubular member connector may be a right hand thread.

The first tubular member connector having the left hand thread may be arranged closest to the top of the well in relation to the tubular member which is fastened to the second tubular member connector, and the second tubular member connector having the right hand thread may thus be arranged on the other side of the tubular member, and as the well tubular structure is rotated while it is run in hole, the first tubular member connector and the second tubular member connector may then be further tightened instead of being unscrewed.

Moreover, the assembly connection part may have a solid massive wall. By a solid massive wall is meant that the wall has no channels or openings.

Furthermore, the tubular member may comprise a screen.

In addition, the tubular member may comprise at least one radially extending projection part.

Also, the projection part may be a dimple.

Further, the tubular member may be solid or massive, meaning that it has no openings or channels.

Additionally, the tubular member may be unperforated, meaning that it has no openings or channels.

The completion system as described above may further comprise a third tubular member for connecting the screen element fixation part to a connection part of the annular barrier assembly.

Furthermore, the annular barrier assembly may further comprise an anti-collapse unit.

The present invention also relates to a completion method for completing the completion system according to the present invention in a borehole of a well, said completion method comprising:

providing a first screen assembly, mounting a second screen assembly to the first screen assembly by means of an assembly connection part, sliding a first tubular member along a tubular screen element of the first or second screen assembly, and positioning the first tubular member opposite the assembly connection part.

Moreover, the completion method may comprise submerging the first screen assembly and the second screen assembly into the borehole.

Further, the completion system may comprise a first tubular member connector and a second tubular member connector having an outer diameter which is equal to or larger than the outer diameter of the tubular screen element, and the first tubular member connector and the second tubular member connector may be moved along the longitudinal extension towards the first tubular member to fasten the first tubular member opposite the assembly connection part.

Also, the completion system may further comprise a third screen assembly and a flow section mounted between the second screen assembly and the third screen assembly.

In addition, the completion system may further comprise a second tubular member which is slid along the tubular screen element of the second or third screen assembly, positioning the second tubular member opposite the flow section.

Furthermore, one tubular member may be arranged straddling over both the assembly connection part and the flow section.

Thus, one tubular member may be arranged opposite both the assembly connection part and the flow section.

The present invention further relates to a production method for producing hydrocarbon-containing fluid from a reservoir into a well tubular structure, comprising:

letting fluid in through a first screen assembly of a completion system as described above, letting the fluid past a space between a first tubular member and an assembly connection part, letting the fluid flow between a tubular screen element and a base pipe section of a second screen assembly, and letting the fluid flow into a space under a second tubular element and into a flow section and into the well tubular structure.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
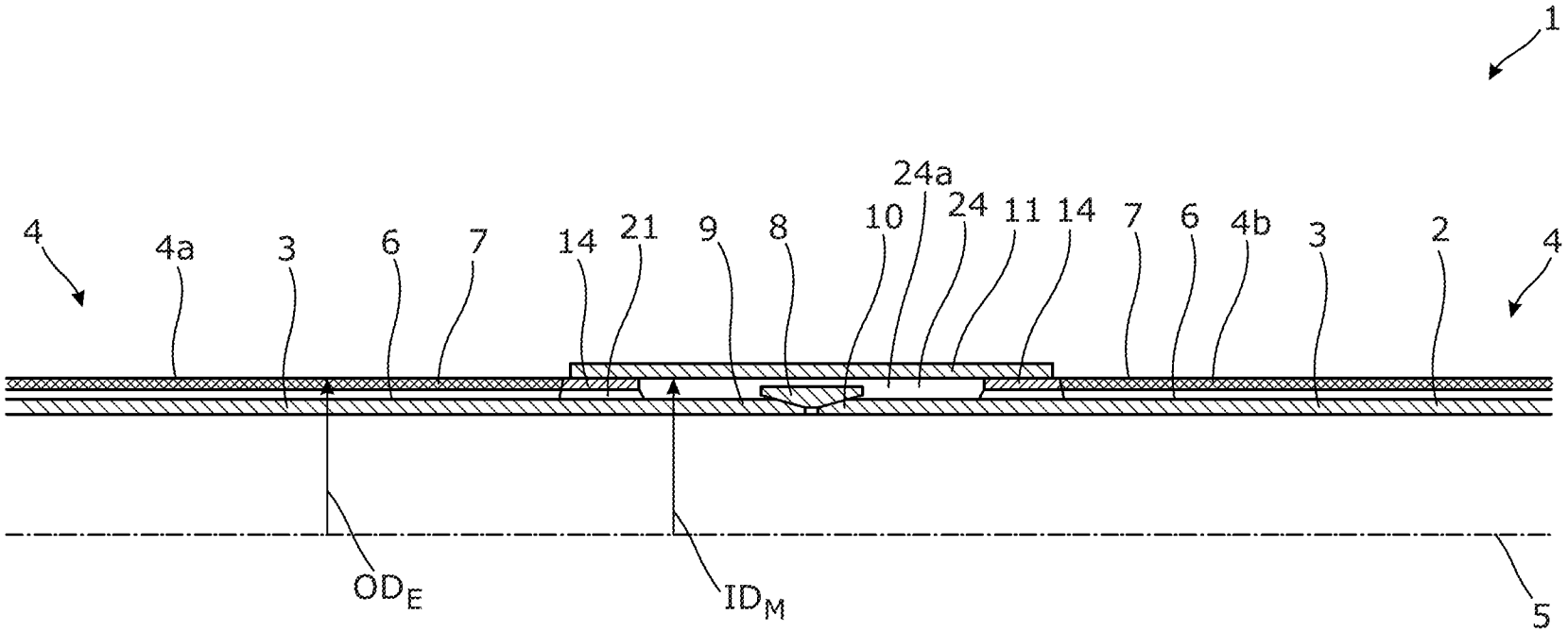
FIG. 1 shows a cross-sectional view of a completion system.

FIG. 1 shows a completion system 1 for connecting several screen assemblies 4 into a well tubular structure 2. Each screen assembly comprises a base pipe section 3 mounted to form part of the well tubular structure, so that the base pipe section and the well tubular structure have coincident centre axes along a longitudinal extension 5 of the well tubular structure. The base pipe sections 3 are mounted together by means of an assembly connection part 8 for connecting an end 9 of a first screen assembly 4, 4*a* with an end 10 of a second screen assembly 4, 4*b*. Each base pipe section 3 has an outer face 6 and a tubular screen element 7 of each screen assembly, which tubular screen element surrounds the outer face of the base pipe section and is connected to the outer face of the base pipe section.

The completion system further comprises a first tubular member 11 having an inner diameter $ID_M$ which is equal to or larger than an outer diameter $OD_E$ of the tubular screen element. The first tubular member 11 is arranged opposite the assembly connection part 8 forming an annular space 24, so that fluid flowing in through the tubular screen element 7 of one of the screen assemblies 4 flows on the outside of the assembly connection part 8. By having the first tubular member 11, the base pipe sections 3 can be mounted by assembly connection parts 8 being standard casing collars or casing couplings. Thus, the assembly connection parts 8 do not have to be complicated, specially designed couplings which have to undergo separate qualifications, and such specially designed couplings may also increase the overall costs associated with the completion system 1 and thus the well.

Figure 2:
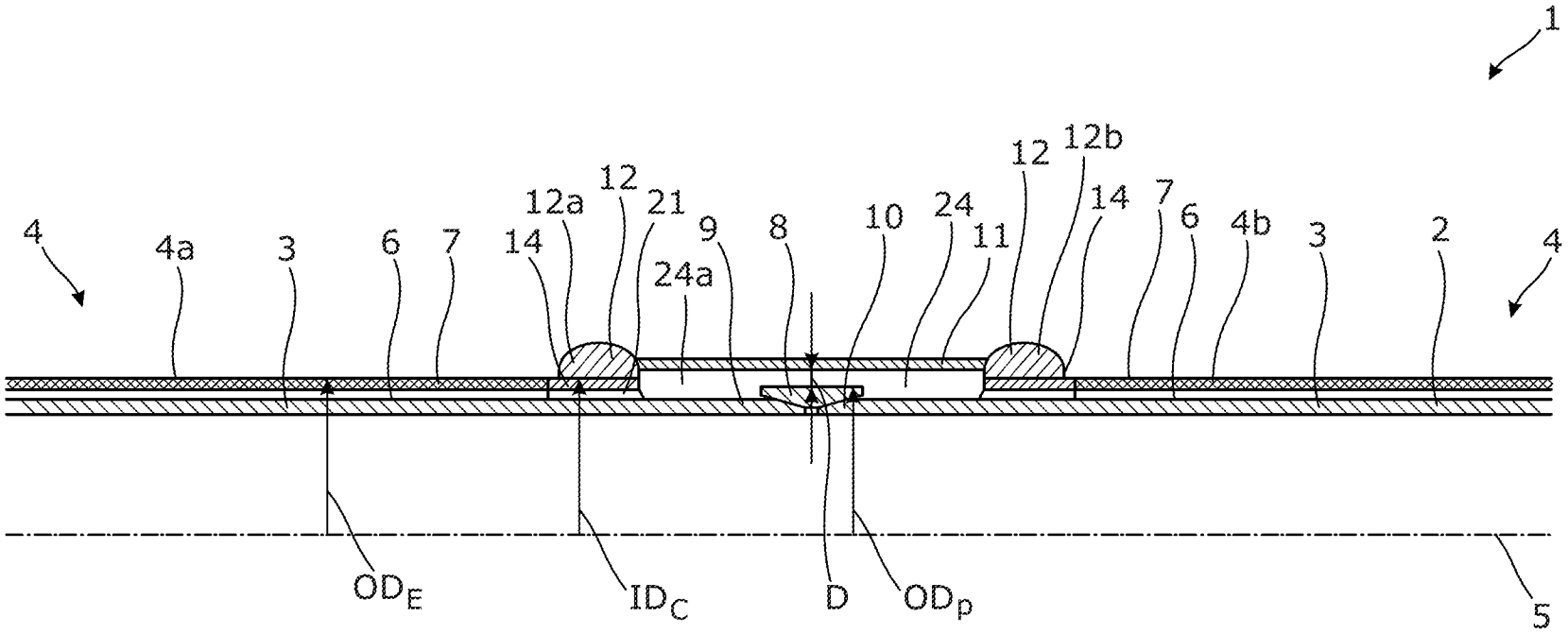
FIG. 2 shows a cross-sectional view of another completion system.

In FIG. 2, the completion system 1 further comprises a first tubular member connector 12, 12*a* and a second tubular member connector 12, 12*b* having inner diameters $ID_C$ which are equal to or larger than the outer diameter $OD_E$ of the tubular screen element 7. The first tubular member 11 is maintained in at least the longitudinal extension 5 by the tubular member connectors 12, 12*a*, 12*b*. By having tubular member connectors having an inner diameter which is equal to or larger than the outer diameter of the tubular screen element, the tubular member connectors are able to slide along the tubular screen element 7 during mounting of the completion system 1, and the first tubular member 11 is then also able to slide along the tubular screen element 7 and remain opposite the tubular screen element 7 while the first screen assembly 4, 4*a* and the second screen assembly 4, 4*b* are mounted by means of the assembly connection part 8 which may be a standard casing collar or casing coupling. During connection of two base pipe sections 3 of the two screen assemblies 4, the tools at the rig need to get a firm grip around the base pipe sections 3, and during this connection step there is no room for the first tubular member 11, nor the tubular member connectors 12, 12*a*, 12*b* fastening the first tubular member 11. Thus, during mounting of the base pipe sections 3, the first tubular member 11 and the first tubular member connector 12, 12*a* are arranged opposite the tubular screen element 7 of the first screen assembly 4, 4*a*, and the second tubular member connector 12, 12*b* is arranged opposite the tubular screen element 7 of the second screen assembly 4, 4*b*. After mounting of the base pipe section 3 of the first screen assembly 4, 4*a* with the base pipe section 3 of the second screen assembly 4, 4*b* by means of the assembly connection part 8, the first tubular member 11 is slid along the tubular screen element 7 and arranged opposite the assembly connection part 8, and then the first tubular member connector 12, 12*a* and the second tubular member connector 12, 12*b* are slid along the tubular screen elements 7, fastening the first tubular member 11 from either side in a position opposite the assembly connection part 8, so that fluid from the first screen assembly 4, 4*a* can flow on the outside of the assembly connection part 8 underneath the second screen assembly 4, 4*b*. Thus, the first tubular member and the base pipe section form an annular flow channel 24*a*.

Each screen assembly 4 comprises a screen element fixation part 14 adapted to fixate the tubular screen element 7 to the base pipe section. The screen element fixation part 14 has a plurality of flow channels 21 distributed around the periphery of the base pipe section 3. The flow channels 21 extend along the longitudinal extension to fluidly connect the screen with the annular flow channel 24*a*. The first tubular member connector 12, 12*a* is arranged so as to partly overlap the screen element fixation part 14 of the first screen assembly 4, 4*a*, and the second tubular member connector 12, 12*b* is arranged so as to partly overlap the screen element fixation part 14 of the second screen assembly 4, 4*b*. In order to be able to be fastened to the screen element fixation parts, the tubular member connectors 12 have internal threads and the screen element fixation part 14 has an external thread for engagement with the internal threads of the tubular member connectors 12. Thus, the tubular member 11 is not directly connected to the assembly connection part 8 but bridges or straddles over the assembly connection part, forming a distance D from the outer face of the assembly connection part to the tubular member 11, as shown in FIG. 2. The assembly connection part 8 has an outer diameter $OD_P$ which is larger than the outer diameter of the base pipe section 3, and the distance between the tubular member 11 and the base pipe section is greater than the distance D. The assembly connection part 8 may also have an outer diameter $OD_P$ which is equal to the outer diameter of the base pipe section 3. The assembly connection part is one way of assembling two base pipes/casings. Another way could be by means of integral flush joint casings or casings with upset connections.

During mounting of the base pipe sections 3, the first tubular member connector 12, 12*a* is arranged opposite the tubular screen element 7 of the first screen assembly 4, 4*a*, and the first tubular member 11 and the second tubular member connector 12, 12*b* are arranged opposite the tubular screen element 7 of the second screen assembly 4, 4*b*. After mounting of the base pipe section 3 of the first screen assembly 4, 4*a* with the base pipe section 3 of the second screen assembly 4, 4*b* by means of the assembly connection part 8, the first tubular member 11 is slid along the tubular screen element 7 of the second screen assembly and arranged opposite the assembly connection part 8, and subsequently the first tubular member connector 12, 12*a* and the second tubular member connector 12, 12*b* are slid along the tubular screen elements 7, fastening the first tubular member 11 from either side in a position opposite the assembly connection part 8, so that fluid from the first screen assembly 4, 4*a* is able to flow on the outside of the assembly connection part 8 underneath the second screen assembly 4, 4*b*. Thus, the first tubular member and the base pipe section form an annular flow channel 24*a*. By arranging the first tubular member 11 opposite the tubular screen element 7 of the second screen assembly 4, 4*b*, the first tubular member 11 is to be mowed downwards during mounting and not upwards as if it was mounted on the first screen assembly. The tubular member 11 is then held in place during mounting by a fastening tool (not shown).

As shown in FIG. 2, the assembly connection part 8 has a solid massive wall and the tubular member 11 is solid or massive, and the wall of the assembly connection part and tubular member is thus unperforated, meaning that the assembly connection part and the tubular member have no openings or channels.

The thread of the first tubular member connector 12, 12*a* is a left hand thread and the thread of the second tubular member connector 12, 12*b* is a right hand thread. The first tubular member connector 12, 12*a* having the left hand thread is arranged closest to the top of the well in relation to the tubular member 11 which is fastened to the second tubular member connector 12, 12*b*, and the second tubular member connector 12, 12*b* having the right hand thread is thus arranged on the other side of the tubular member. During insertion of the well tubular structure in the borehole, the well tubular structure is often rotated clockwise, and the first tubular member connector 12, 12*a* and second tubular member connector 12, 12*b* are then further tightened instead of being unscrewed when run in hole. In situations in which the tubluar structure has to be rotated anti-clockwise, the arrangement of the left handed and right handed connectors would be swapped.

Figure 3:
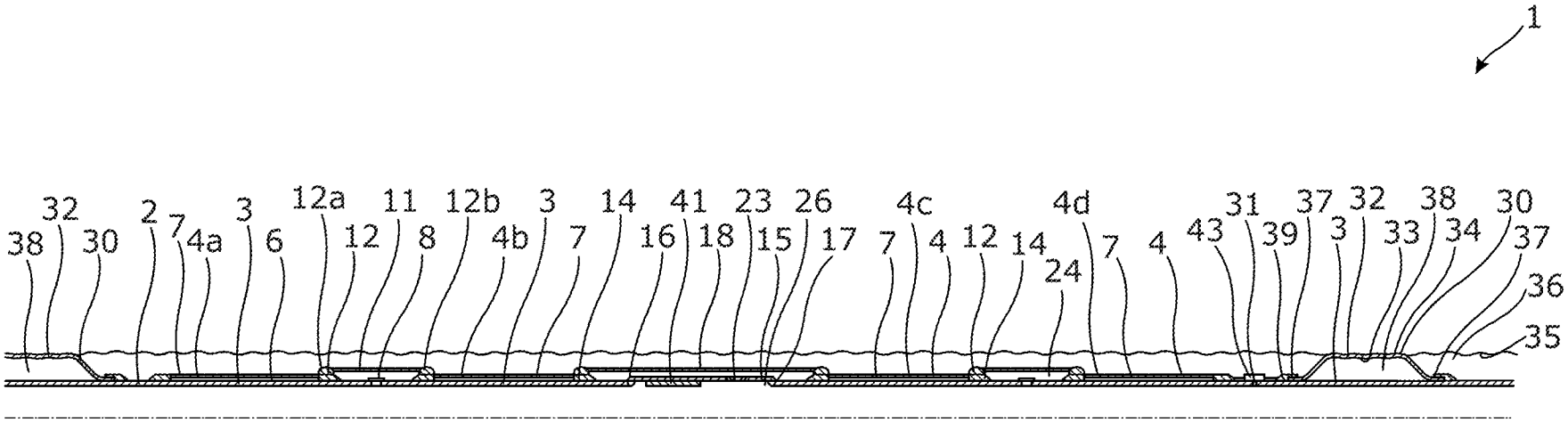
FIG. 3 shows a cross-sectional view of another completion system having annular barrier assemblies.

In FIG. 3, each screen assembly 4 comprises two screen element fixation parts 14 to fixate each end of the tubular screen element 7 to the base pipe section 3. Furthermore, the well tubular structure 2 has an opening 23 for letting the fluid into the well tubular structure. The completion system further comprises a flow section 15 mounted as part of the well tubular structure for allowing fluid to flow into or out of the well tubular structure through the opening 23 in the flow section 15 for letting fluid from the screen assemblies into the well tubular structure. The flow section is mounted between two screen assemblies so that the first screen assembly 4, 4*a* and second screen assembly 4, 4*b* are mounted on one side of the flow section, and a third screen assembly 4, 4*c* and a fourth screen assembly 4, 4*d* are mounted on the other side of the flow section 15. The flow section 15 has a first end 16 mounted to the second screen assembly 4, 4*b* and a second end 17 mounted to the third screen assembly 4, 4*c*.

The completion system 1 shown in FIG. 3 further comprises a second tubular member 18 arranged opposite the flow section 15, so that fluid flowing in through the tubular screen element of one of the screen assemblies 4, 4*a*, 4*b*, 4*c*, 4*d* flows on the outside of the base pipe section 3 and in through the flow section 15, or vice versa, in the event that fluid, e.g. fracturing fluid, cleaning fluid or acid, flows from the base pipe section through the opening 23 and out through the screen assemblies. The completion system 1 further comprises two annular barrier assemblies 30. Each annular barrier assembly 30 comprises a base pipe section 3 for being mounted as part of the well tubular structure 2 and the base pipe section comprises an aperture 31 for letting fluid therethrough to expand the annular barrier assembly. Each annular barrier assembly 30 further comprises an expandable sleeve 32 surrounding the base pipe section 3 and having an inner face 33 facing the base pipe section 3 and an outer face 34 facing a wall 35 of a borehole 36. Each end 37 of the expandable sleeve 32 is connected with the base pipe section 3, forming an annular space 38 between the inner face of the expandable sleeve 32 and the base pipe section 3.

As shown in FIG. 3, the annular barrier assembly 30 further comprises an anti-collapse unit 43, so that after expansion the fluid connection between the aperture 31 and the annular space 38 is closed, and a fluid connection between the annular space and the borehole is opened. The fluid connection to the borehole may further run through the adjacent screen assembly 4.

Figure 4:
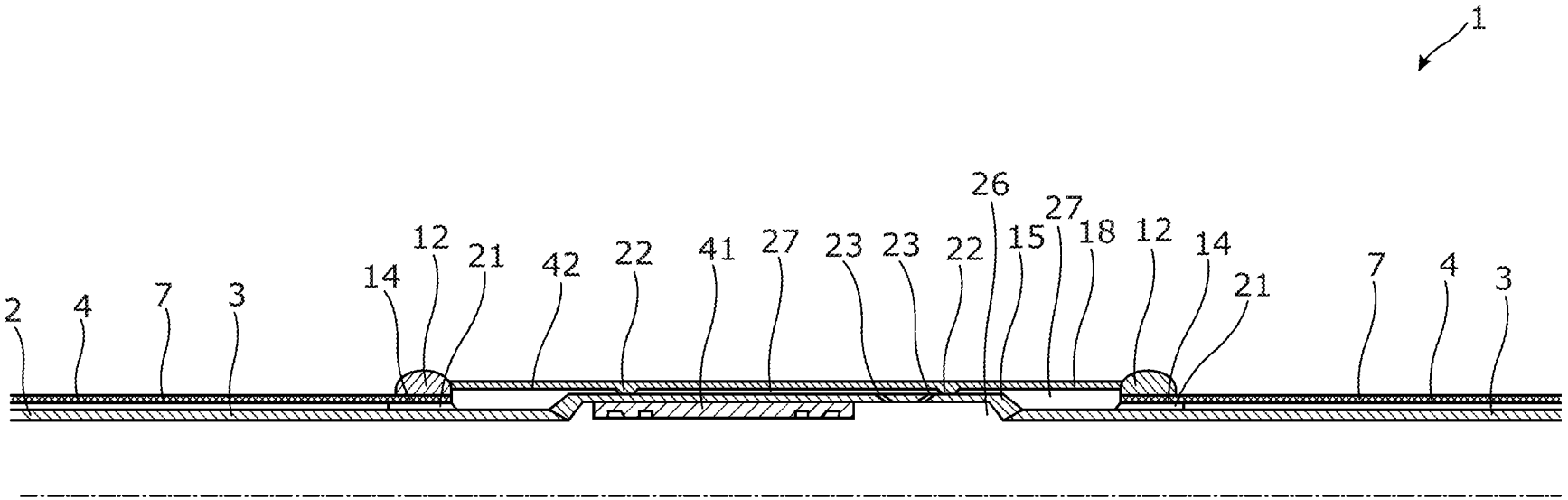
FIG. 4 shows a cross-sectional view of another completion system having a flow section.

In FIG. 4, the flow section 15 comprises a sliding sleeve 41 for covering the opening 23. The flow section has a groove 26 in which the sliding sleeve 41 slides without decreasing the inner diameter of the base pipe section. The second tubular member 18 comprises radially extending projection parts 22 to ensure that there is always a distance, so that the fluid can flow to the opening 23 even though the pressure in the borehole is higher than the pressure in the annular space 27. The projection part may be a dimple.

Figure 5:
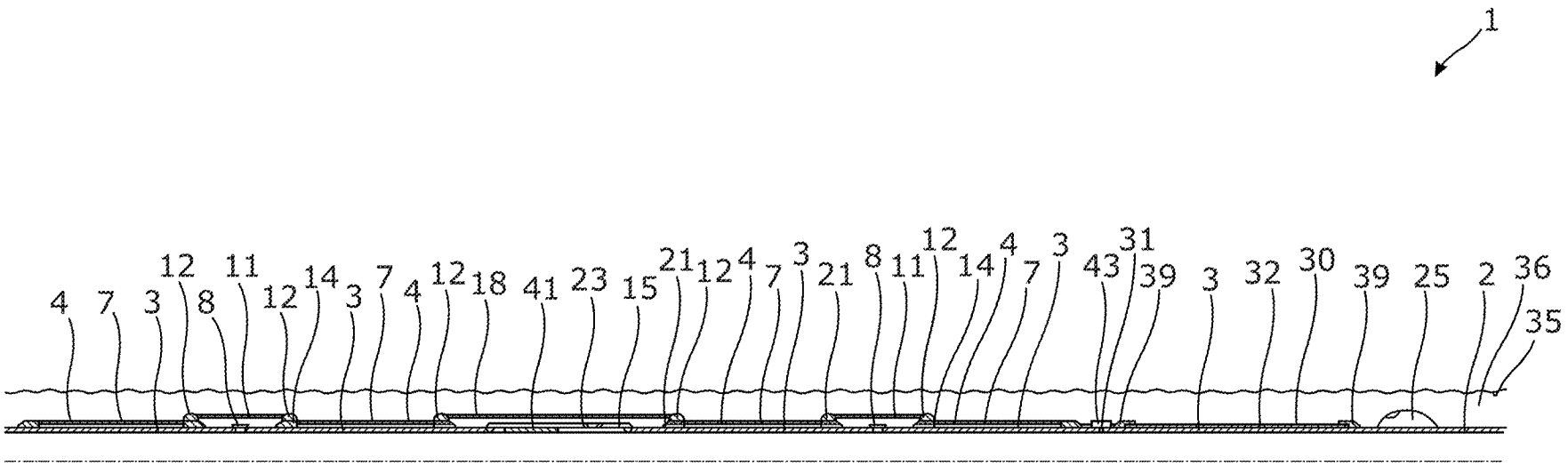
FIG. 5 shows a cross-sectional view of another completion system having centralisers.

The completion system may further comprise centralisers 25 for centralising the well tubular structure when the structure is run in the borehole, as shown in FIG. 5. The centralisers 25 are arranged close to the screen assemblies to protect them while the well tubular structure is run in hole. The centralisers ensure a certain distance from the well tubular structure to the wall of the borehole, so that projections or ledges in the borehole wall do not harm the function of the screen assemblies while the screen assemblies pass down the borehole. In FIG. 5, the annular barrier assembly 30 is shown in its unexpanded position and is arranged between the centraliser and one of the screen assemblies. The tubular member connector 12 could also be a centraliser, besides functioning as a tubular member connector. Even though not shown in FIG. 5, the completion system does not necessarily have the second tubular member 18 arranged opposite the flow section 15, but merely to one side if screen assemblies are only arranged at the one side.

Figure 6:
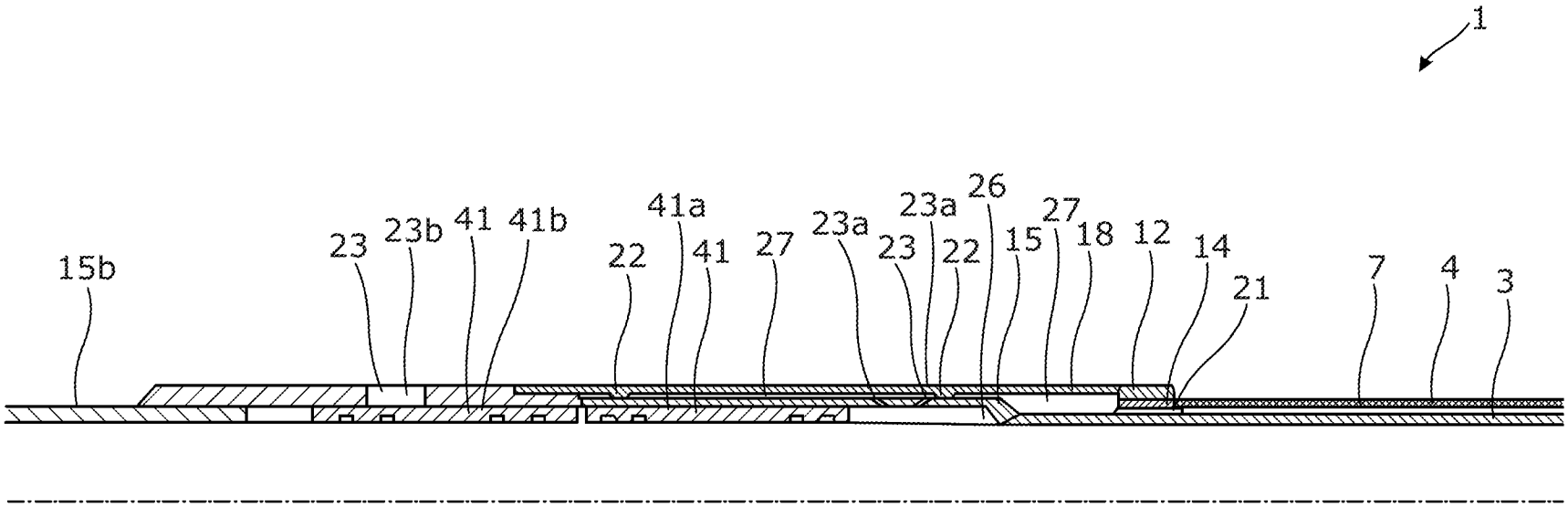
FIG. 6 shows a cross-sectional view of another completion system.

In FIG. 6, the flow section 15 comprises two sliding sleeves 41, a first sliding sleeve 41, 41*a* for covering a first opening 23, 23*a* and a second sliding sleeve 41, 41*b* for covering a second opening 23, 23*b* through which fluid for fracturing the formation or another fluid for treating the formation can flow. The flow section 15 further comprises a flow section connector 15*b* to connect to another base pipe. Thus, the sliding sleeves 41, 41*a*, 41*b* are slid into the groove 26 of the flow section 15 and then the flow section connector 15*b* is connected so that the sliding sleeves are restricted to slide in the groove 26.

The first tubular members opposite the assembly connection parts 8 may also comprise at least one radially extending projection part to ensure the distance D shown in FIG. 2.

The completion system may further comprise a third tubular member 7 for connecting the screen element fixation part to a connection part 39 of the annular barrier assembly.

Furthermore, the tubular member may comprise a screen 42, shown in FIG. 4. And in another embodiment, one of the base pipe sections 3 may have an opening 23 for letting the fluid into the well tubular structure.

When completing the well, the base pipe sections 3 of the first screen assembly 4, 4*a* and second screen assembly 4, 4*b* are mounted by means of an assembly connection part 8 or directly without the assembly connection part 8 in case of integral flush joints or upset connections, then the first tubular member 11 is slid along the tubular screen element 7 of the first screen assembly and positioned opposite and over the assembly connection part. Thus sufficient space is left on the base pipe/casing for clamping of the base pipe using conventional rig equipment. Then the first tubular member connector 12, 12*a* is slid along the tubular screen element 7 of the first screen assembly 4, 4*a*, and the second tubular member connector 12, 12*b* is slid along the tubular screen element 7 of the second screen assembly 4, 4*b*, and both tubular member connectors are threadingly engaging external threads on the screen element fixation parts 14, thereby fastening the tubular member therebetween. Subsequently, a flow section 15 is mounted as part of the well tubular structure by connecting the flow section 15 to an end of a base pipe section 3 of one of the screen assemblies. Then further screen assemblies may be mounted as part of the well tubular structure 2 before an annular barrier assembly is mounted as part of the well tubular structure 2 to isolate a first zone of the borehole from a second zone of the borehole. An annular barrier assembly may be mounted in each end of the section comprising the screen assemblies and the flow section to isolate the zone of the borehole opposite the screen assemblies. By having several assemblies mounted together, a greater inflow area is created, and if one of the screen assemblies is blocked, the fluid from the reservoir can flow in through other screen assemblies in the same production zone. By having only one flow section through which the fluid can flow into the well tubular structure, the zone can easily be shut off if the zone starts producing too much water.

The second tubular member is mounted in the same way as the first tubular member and is thus slid along the tubular screen element of the second or third screen assembly, positioning the second tubular member opposite and over the flow section, and is fastened by tubular member connector 12 which is also slid along the tubular screen element 7.

When the completion system is mounted and run in hole, production is initiated by letting fluid in through the first screen assembly 4,4*a* of a completion system and past the annular space 24 between the first tubular member 11 and an assembly connection part 8. Then the fluid flows between the tubular screen element 7 and the base pipe section 3 of the second screen assembly 4, 4*b* and into the annular space 27 under the second tubular element 18 and into the flow section 15 and in through the opening 23 into the well tubular structure. The fluid let in through the first screen assembly may also flow directly into the annular space 27 opposite the flow section.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a well tubular structure, a casing or production casing is meant any kind of pipe, tubing, tubular, liner, string etc. used downhole in relation to oil or natural gas production.

Although the invention has been described in the above in connection with preferred embodiments of the invention, it will be evident for a person skilled in the art that several modifications are conceivable without departing from the invention as defined by the following claims.

The invention claimed is:

1. A completion system for connecting several screens into a well tubular structure mounted from base pipe sections, comprising:

a first screen assembly and a second screen assembly, each screen assembly comprising:

a base pipe section mounted as part of the well tubular structure having a longitudinal extension, the base pipe section having an outer face, and a tubular screen element surrounding and being connected to the outer face of the base pipe section, and an assembly connection part for connecting an end of the first screen assembly with an end of the second screen assembly, wherein the completion system further comprises:

a first tubular member having a minimum inner diameter which is equal to or larger than a maximum outer diameter of the tubular screen element, the first tubular member being arranged opposite the assembly connection part so that fluid flowing in through the tubular screen element of one of the screen assemblies flows on the outside of the assembly connection part, a flow section mounted as part of the well tubular structure for allowing fluid to flow into or out of the well tubular structure, the flow section including a first end mounted to an end of the base pipe section of the second screen assembly, and a second tubular member arranged opposite the flow section so that fluid flowing in through the tubular screen element of one of the screen assemblies flows on the outside of the base pipe section and in through the flow section.

2. A completion system according to claim 1, further comprising a first tubular member connector and a second tubular member connector, each tubular member connector having a minimum inner diameter which is equal to or larger than the maximum outer diameter of the tubular screen element, and the first tubular member is maintained in at least the longitudinal extension by the tubular member connectors.

3. A completion system according to claim 2, wherein each screen assembly comprises a screen element fixation part adapted to fixate the tubular screen element to the base pipe section.

4. A completion system according to claim 3, wherein the first tubular member connector is arranged so as to at least partly overlap the screen element fixation part of the first screen assembly, and the second tubular member connector is arranged so as to at least partly overlap the screen element fixation part of the second screen assembly.

5. A completion system according to claim 3, wherein the screen element fixation part has an external thread.

6. A completion system according to claim 2, wherein the first tubular member connector and the second tubular member connector have internal threads.

7. A completion system according to claim 2, wherein the first tubular member connector and the second tubular member connector are slidable on the outer face of the base pipe section during assembly of the first screen assembly and the second screen assembly.

8. A completion method for completing the completion system according to claim 2 in a borehole of a well, said completion method comprising:

providing the first screen assembly, mounting the second screen assembly to the first screen assembly by means of the assembly connection part, sliding the first tubular member along the tubular screen element of the first screen assembly or the second screen assembly, and positioning the first tubular member opposite the assembly connection part.

9. A completion method according to claim 8, wherein the completion system comprises a first tubular member connector and a second tubular member connector, each having an outer diameter which is equal to or larger than the outer diameter of the tubular screen element, and wherein the first tubular member connector and the second tubular member connector are moved along the longitudinal extension towards the first tubular member to fasten the first tubular member opposite the assembly connection part.

10. A completion method according to claim 8, wherein the completion system further comprises a third screen assembly and a flow section mounted between the second screen assembly and the third screen assembly.

11. A completion method according to claim 10, wherein the completion system further comprises a second tubular member which is slid along the tubular screen element of the second screen assembly or the third screen assembly, positioning the second tubular member opposite the flow section.

12. A completion method according to claim 8, wherein the sliding includes:

before the mounting the second screen assembly to the first screen assembly, sliding the first tubular member along the tubular screen element of the first screen assembly to be arranged opposite the tubular screen element of the first screen assembly and away from the end of the first base pipe section of the first screen assembly that is to be connected to the base pipe section of the second screen assembly, and wherein the positioning the first tubular member opposite the assembly connection part is after the mounting the second screen assembly to the first screen assembly.

13. A completion system according to claim 2, wherein the first tubular member connector and the second tubular member connector are slidable on the outer face of the base pipe section before and after the ends of the first and second screen assemblies are connected by the assembly connection part.

14. A completion system according to claim 1, further comprising at least one annular barrier assembly comprising:

a base pipe section for being mounted as part of the well tubular structure, the base pipe section comprising an aperture, an expandable sleeve surrounding the base pipe section and having an inner face facing the base pipe section and an outer face facing a wall of a borehole or another well tubular structure, each end of the expandable sleeve being connected with the base pipe section, and an annular space between the inner face of the expandable sleeve and the base pipe section.

15. A production method for producing hydrocarbon-containing fluid from a reservoir into a well tubular structure, comprising:

letting fluid in through a first screen assembly of a completion system according to claim 1, letting the fluid past an annular space between the first tubular member and the assembly connection part, letting the fluid flow between the tubular screen element and the base pipe section of a second screen assembly, and letting the fluid flow into an annular space under a second tubular element and into a flow section and into the well tubular structure.

16. The completion system according to claim 1, further comprising a third screen assembly comprising:

a base pipe section mounted as part of the well tubular structure having a longitudinal extension, the base pipe section having an outer face;

a tubular screen element surrounding and being connected to the outer face of the base pipe section; and wherein the flow section includes a second end mounted to the base pipe section of the third screen assembly in order to connect the second screen assembly to the third screen assembly.

17. The completion system according to claim 1, further comprising a flow channel between the base pipe section and the tubular screen element of each of the first screen assembly and the second screen assembly, the flow channel of the first screen assembly and the flow channel of the second screen assembly each extend along a longitudinal length and are each connected to an annular space between the assembly connection part and the first tubular member.

18. The completion system according to claim 1, wherein at least a portion of an outer surface at the maximum outer diameter of the tubular screen element of the first screen assembly is configured to be an outermost surface of the completion system, and/or at least a portion of an outer surface at the maximum outer diameter of the tubular screen element of the second screen assembly is configured to be an outermost surface of the completion system.

19. The completion system according to claim 1, wherein the fluid is hydrocarbon-containing fluid that is configured to flow from a reservoir and into the well tubular structure through the tubular screen element of one of the screen assemblies and/or through the flow section.

20. A completion system for connecting several screens into a well tubular structure mounted from base pipe sections, comprising:

a first screen assembly and a second screen assembly, each screen assembly comprising:

a base pipe section mounted as part of the well tubular structure having a longitudinal extension, the base pipe section having an outer face, and a tubular screen element surrounding and being connected to the outer face of the base pipe section, and an assembly connection part for connecting an end of the first screen assembly with an end of the second screen assembly, wherein the completion system further comprises a first tubular member having a minimum inner diameter which is equal to or larger than a maximum outer diameter of the tubular screen element, the first tubular member being arranged opposite the assembly connection part so that fluid flowing in through the tubular screen element of one of the screen assemblies flows on the outside of the assembly connection part, further comprising a first tubular member connector and a second tubular member connector, each tubular member connector having a minimum inner diameter which is equal to or larger than the maximum outer diameter of the tubular screen element, and the first tubular member is maintained in at least the longitudinal extension by the tubular member connectors.

21. A completion system for connecting several screens into a well tubular structure mounted from base pipe sections, comprising:

a first screen assembly and a second screen assembly, each screen assembly comprising:

a base pipe section mounted as part of the well tubular structure having a longitudinal extension, the base pipe section having an outer face, and a tubular screen element surrounding and being connected to the outer face of the base pipe section, and an assembly connection part for connecting an end of the first screen assembly with an end of the second screen assembly, wherein the completion system further comprises:

a first tubular member having a minimum inner diameter which is equal to or larger than a maximum outer diameter of the tubular screen element, the first tubular member being arranged opposite the assembly connection part so that fluid flowing in through the tubular screen element of one of the screen assemblies flows on the outside of the assembly connection part, and at least one annular barrier assembly comprising:

a base pipe section for being mounted as part of the well tubular structure, the base pipe section comprising an aperture, an expandable sleeve surrounding the base pipe section and having an inner face facing the base pipe section and an outer face facing a wall of a borehole or another well tubular structure, each end of the expandable sleeve being connected with the base pipe section, and an annular space between the inner face of the expandable sleeve and the base pipe section.

* * * * *